US005199506A

United States Patent [19]

Dewey et al.

[11] Patent Number: 5,199,506

[45] Date of Patent: Apr. 6, 1993

[54] FASTENER-DRIVING TOOL ASSEMBLY WITH IMPROVED FASTENER-LOADING FEATURES

[75] Inventors: George G. Dewey, Prospect Heights; Ronald J. Allen, Geneva, both of Ill.

[73] Assignee: Illinois Tool Works Inc., Glenview, Ill.

[21] Appl. No.: 941,608

[22] Filed: Sep. 8, 1992

Related U.S. Application Data

[62] Division of Ser. No. 765,840, Sep. 26, 1991.

[51] Int. Cl.[5] ..... B25C 1/14

[52] U.S. Cl. ..... 173/104; 227/8; 227/113; 227/119; 227/120; 227/139

[58] Field of Search ..... 227/8, 113, 114, 119, 227/120, 135, 138, 139; 173/104

[56] References Cited

U.S. PATENT DOCUMENTS

| | | | |
|---|---|---|---|
| 2,901,749 | 9/1959 | Crossen et al. | 227/149 |
| 3,929,176 | 12/1975 | Dixon | 227/119 |
| 4,463,888 | 8/1984 | Geist et al. | 227/119 |
| 4,487,355 | 12/1984 | Ginnow et al. | 227/130 |
| 4,765,057 | 8/1988 | Muller | 227/119 |
| 4,824,003 | 4/1989 | Almeras et al. | 227/10 |

*Primary Examiner*—Frank T. Yost
*Assistant Examiner*—Scott A. Smith
*Attorney, Agent, or Firm*—Schwartz & Weinrieb

[57] ABSTRACT

In a fastener-driving tool, such as a powder-actuated tool, a nosepiece has an aperture, through which a fastener can be axially driven. A shuttle has a passageway to receive the fastener, as guided by a flexible tube, in a fastener-receiving position of the shuttle. A shuttle-moving mechanism is used to move the shuttle from the fastener-receiving position into a fastener-delivery position. A driving mechanism enables the fastener to be axially driven from the passageway, through the aperture, in the delivery position of the shuttle. A magnet or a spring, such as a torsional spring having an arm to engage the fastener, is used to retain the fastener in a pre-driving position. As a stand-up tool, the tool has a primary trigger and a secondary trigger, which enables the primary trigger to be remotely actuated.

14 Claims, 7 Drawing Sheets

FASTENER-DRIVING TOOL ASSEMBLY WITH IMPROVED FASTENER-LOADING FEATURES

This application is a division of application Ser. No. 765,840, filed Sep. 26, 1991, pending.

TECHNICAL FIELD OF THE INVENTION

This invention pertains to a tool assembly including a fastener-driving tool, such as a powder-actuated tool, and having fastener-loading features facilitating its use by a standing worker who does not have to lift the tool assembly or to stoop when it is desired to reload the fastener-driving tool with individual fasteners.

BACKGROUND OF THE INVENTION

Commonly, fastener-driving tools, such as powder-actuated tools, are arranged to drive fasteners of a known type comprising a shank defining an axis and having a tip at one end, a head integral with the other end of the shank, and a washer carried by the shank with an interference fit. Such fasteners are exemplified in Almeras et al. U.S. Pat. No. 4,824,003.

In such a fastener, the washer is carried near but in spaced relation to the tip and is moveable axially toward the head when the fastener is driven with the washer bearing against a workpiece. The head diameter and the washer diameter are approximately equal.

As exemplified in Almeras et al. U.S. Pat. No. 4,824,003, it is known for such a tool to be muzzle-loaded with such fasteners, which are loaded one at a time. As exemplified in Pfister U.S. Pat. No. 4,881,643, it is known to load a plurality of different fasteners into a powder-actuated tool, via a carrier strip fed laterally into the tool.

A common use of a powder-actuated tool, as exemplified in Almeras et al. U.S. Pat. No. 4,824,003, is to attach metal decking members to steel structural members or concrete floors. For such a use, it would be highly desirable to adapt such a tool so as to facilitate its use by a standing worker. Neither a muzzle-loaded tool nor a strip-loaded tool would be entirely satisfactory, since the worker would have to lift the tool or to stoop whenever it was necessary to reload the tool.

Thus, there has been a need, to which this invention is addressed, for a better approach to loading fasteners into a fastener-driving tool, such as a powder-actuated tool, so as to facilitate its use by a standing worker.

SUMMARY OF THE INVENTION

This invention provides a novel combination of fastener-loading and other elements in a tool assembly including a fastener-driving tool, such as a powder-actuated tool, which is arranged to drive a fastener of the type noted above. The novel combination facilitates the use of the tool assembly by a standing worker who does not have to lift the tool assembly or to stoop when it is desired to reload the fastener-driving tool with individual fasteners.

According to a first aspect of this invention, the tool includes a work-engaging nosepiece through which fasteners are successively driven into work, which may be a metal decking member, for example. The tool includes a fastener-feeding shuttle moveable back and forth to successively feed fasteners from a source of supply into the nosepiece for subsequent driving into the metal decking member. The shuttle has a passageway, which is arranged to receive the fastener and to permit the fastener to be axially driven through the passageway.

The tool includes a structure for guiding the fastener axially into the passageway with the washer preceding the head when the shuttle is in a fastener-receiving position and a mechanism for moving the shuttle from the fastener-receiving position into a fastener-delivery position. The tool further includes a driving ram, which is arranged to be axially driven through the passageway when the shuttle is in the fastener-delivery position, for engaging the head so as to drive the fastener axially from the passageway, through the aperture.

The shuttle is designed to cooperate with fastener-retaining means effective when the shuttle is in the delivery position to prevent the fastener from dropping accidentally prior to being driven from the tool. In one embodiment, the shuttle cooperates with a magnet to retain the fastener in a pre-driving position. In another embodiment, the shuttle is modified to cooperate with a spring to retain the fastener.

The tool includes a main housing for the fastener-driving components and an operating handle. The operating handle is moveable relative to the main housing when the tool is set to drive a fastener. A flexible tube is connected between the housing and the nosepiece for gravity feed of fasteners to the nosepiece. The flexibility of the tube accommodates the movement of the operating handle relative to the main housing.

The several aspects of this invention may be advantageously combined in a assembly including a fastener-driving tool, such as a powder-actuated tool, so as to facilitate its use by a standing worker. There is no need for such a worker to lift the tool assembly or to stoop when it is desired to reload the fastener-driving tool with individual fasteners. Carrier strips are not used.

These and other objects, features, and advantages of this invention are evident from the following description of a preferred embodiment of this invention with reference to the accompanying drawings.

BRIEF DESCRIPTION OF THE DRAWINGS

FIG. 11 shows a fastener having been guided into a passageway of the shuttle. FIG. 11 also shows a metal workpiece and a concrete substrate.

FIG. 13 shows the workpiece and the substrate.

DETAILED DESCRIPTION OF PREFERRED EMBODIMENT

Figures 1, 2:
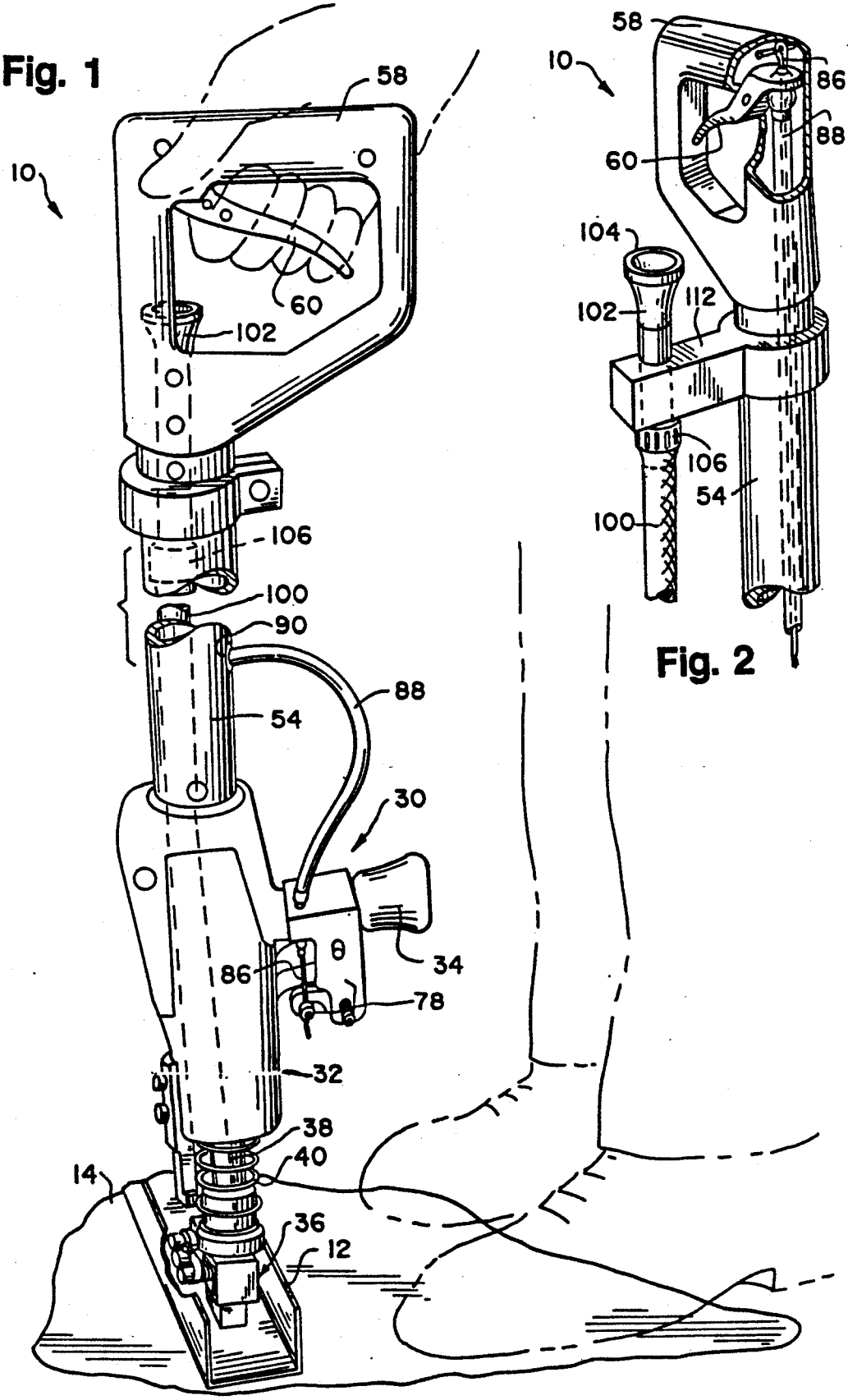
FIG. 1 is a perspective view of a powder-actuated tool embodying this invention. As shown, the tool is being used to drive fasteners through a metal decking member, into a concrete substrate. A standing worker using the tool can be partly seen in phantom lines.
FIG. 2, on a slightly smaller scale, is a fragmentary, perspective view of upper portions of the tool, as seen from a different vantage.
Figure 3:
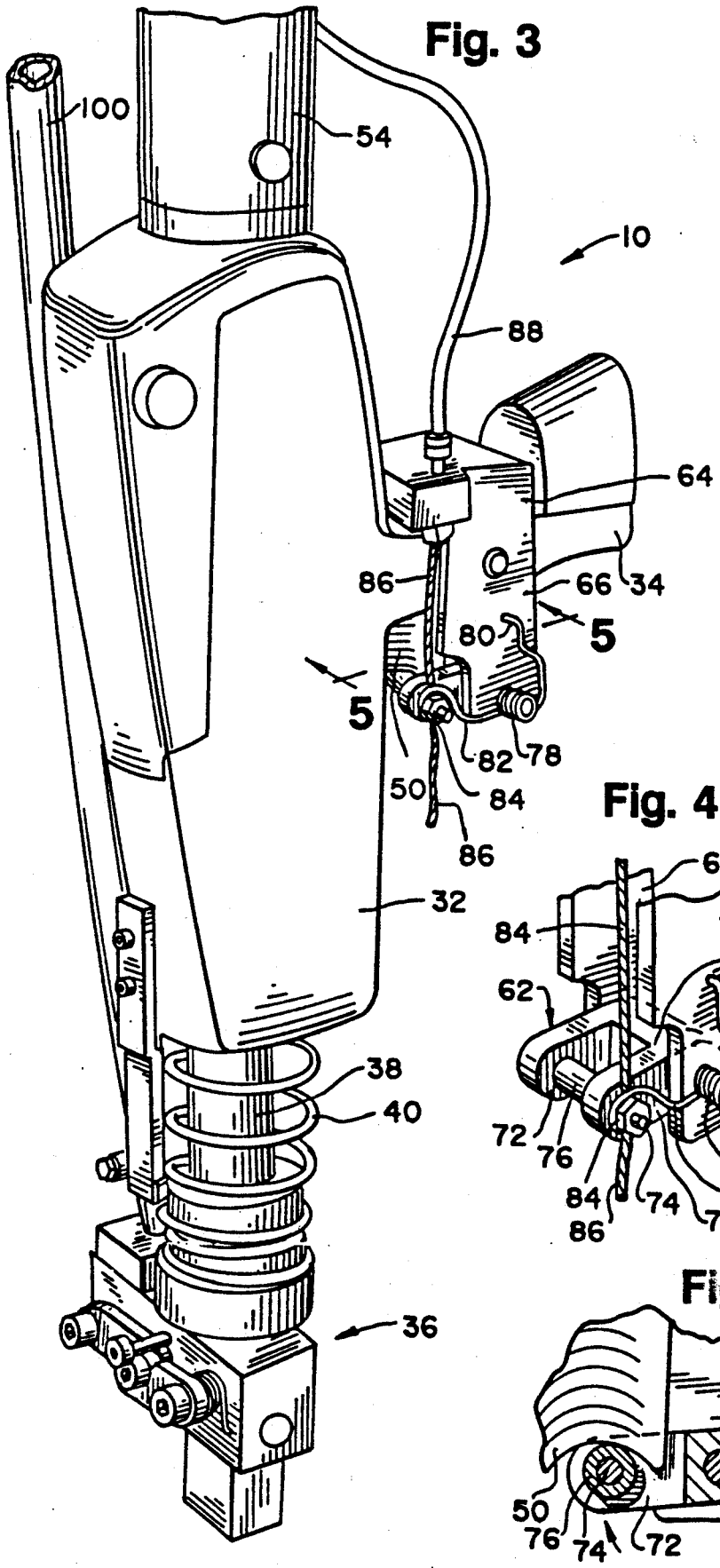
FIG. 3, on a somewhat larger scale, is a fragmentary, perspective view of lower portions of the tool.

As shown in FIGS. 1, 2, and 3, a portable, powder-actuated, fastener-driving tool assembly 10 constitutes a preferred embodiment of this invention. As described below, the tool assembly 10 has fastener-loading features facilitating its use by a standing worker who does not have to lift the tool assembly 10 or to stoop when it is desired to reload the tool assembly 10 with individual fasteners.

One important, exemplary use of the tool assembly 10 is to successively drive fasteners through a metal workpiece, such as a metal decking member 12 shown in FIG. 1, into a steel structural member (not shown) or into a concrete substrate, such as the concrete substrate 14 shown in FIG. 1. The decking member 12 and the concrete substrate 14 are shown also in FIGS. 11, 13, 14, and 15.

Figure 10:
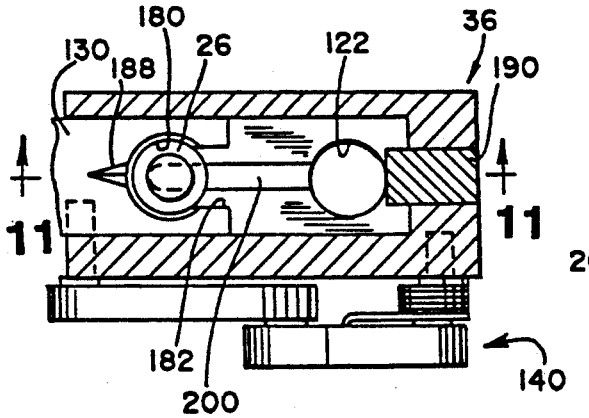
FIG. 10 is a fragmentary, sectional view taken along line 10—10 of FIG. 6, in a direction indicated by arrows.
Figure 12:
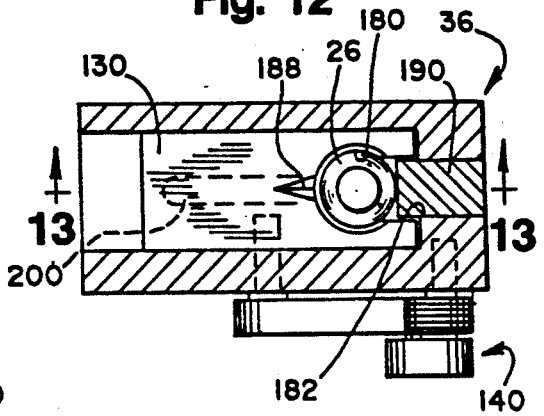
FIG. 12 is a view similar to FIG. 10 but taken with the shuttle in the advanced position.

As shown in FIGS. 10 though 18, the tool assembly 10 is designed to work advantageously with individual fasteners 20, which are not collated, of a type comprising a shank 22 defining an axis and having a tip 24 at one end, a head 26 integral with the other end of the shank 22, and a washer 28 carried by the shank 22 with an interference fit near but in spaced relation to the tip 24. For use with the preferred embodiment of this invention, each fastener 20 is made from a magnetizable metal, such as carbon steel. As mentioned above, such fasteners are exemplified in Almeras et al. U.S. Pat. No. 4,824,003.

Figure 15:
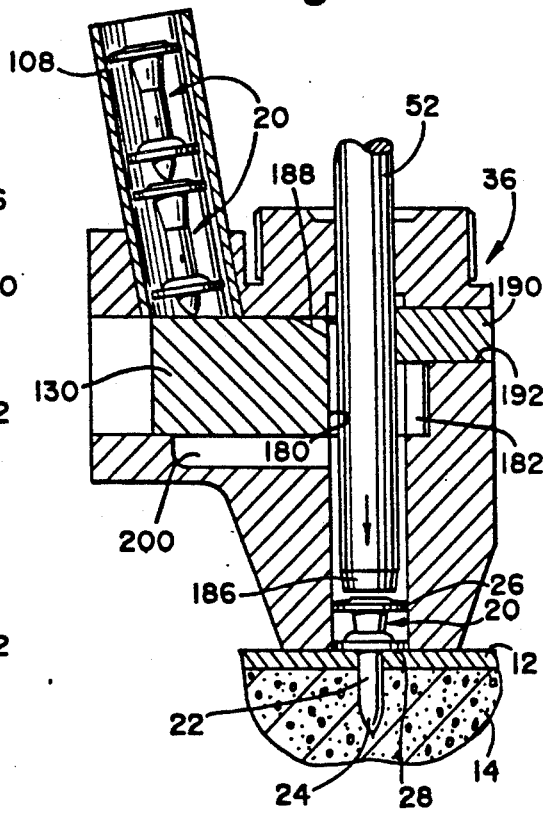
FIG. 15 is a view similar to FIGS. 11, 13, and 14 but taken to show the driving ram having driven the fastener through the workpiece, into the substrate, so as to fasten the workpiece onto the substrate.
Figure 16:
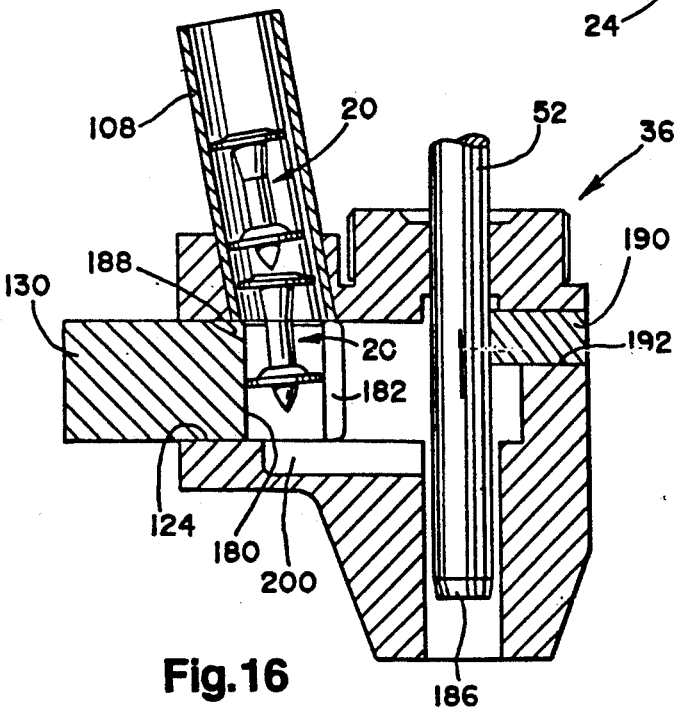
FIG. 16 is a view similar to FIGS. 11, 13, 14, and 15 but taken to show the driving ram being retracted and the shuttle having been retracted. The workpiece, the substrate, and the fastener fastening the workpiece onto the substrate are omitted.

In such a fastener 20, the washer 28 is moveable axially toward the head 26 when the fastener 20 is driven with the washer 28 bearing against a workpiece, such as the decking member 12, as shown in FIG. 15. Ordinarily, as shown in FIG. 15, the washer 28 remains spaced axially from the head 26 after the fastener 20 has been driven. The head 26 defines a head diameter. The washer 28 defines a washer diameter, which is equal approximately to the head diameter.

The tool assembly 10 comprises a portable, powder-actuated, fastener-driving tool 30, which (except as modified for purposes of this invention) is available commercially, as Model P230, from Societe de Prospection et d'Inventions Techniques S.P.I.T. of Valence, France, a subsidiary of Illinois Tool Works Inc. of Glenview, Ill. Various features of the tool 30 are disclosed in prior patents including Almeras et al. U.S. Pat. No. 4,824,003 and Bosch U.S. Pat. No. 4,375,269.

Figure 8:
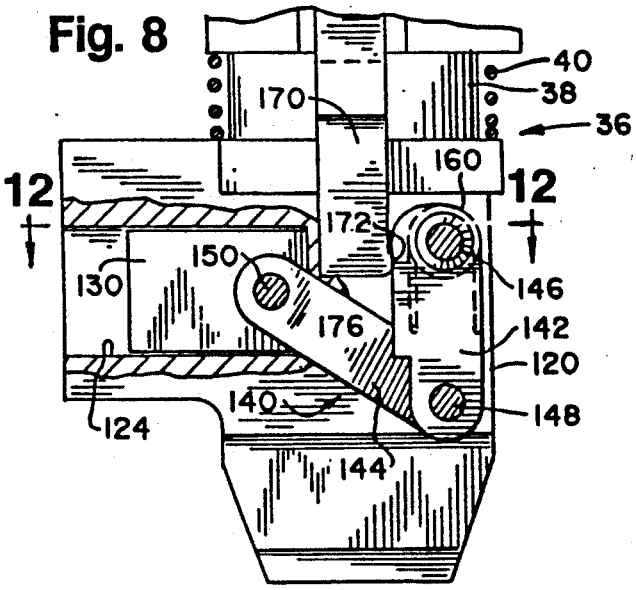
FIG. 8 is a view similar to FIG. 6 but taken with the shuttle in an advanced, fastener-delivery position.
Figure 9:
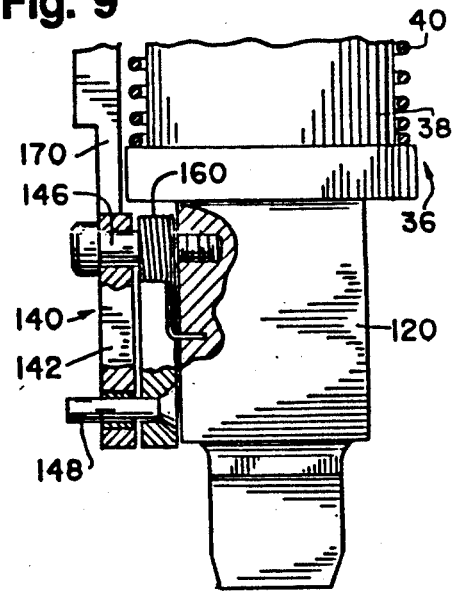
FIG. 9 is a view similar to FIG. 7 but taken with the shuttle in the advanced position.

The tool 30 comprises a housing structure 32, which includes a pistol grip 34, and a nosepiece assembly 36. It is convenient to refer to the pistol grip 34, which is cut away for purposes of this invention, as a primary handle. The nosepiece assembly 36 is mounted to the housing structure 32, via a tubular element 38, so as to permit relative movement of the housing structure 32 and the nosepiece assembly 36, along an axis defined by the tubular element 38, between an extended condition and a retracted condition. A coiled spring 40 is disposed around the tubular member 38, between the housing structure 32 and the nosepiece assembly 36, so as to bias the housing structure 32 and the nosepiece assembly 36 toward the extended condition. The housing structure 32 and the nosepiece assembly 36 are shown in the extended condition in FIGS. 1, 3, 6, and 7 and in the retracted condition in FIGS. 8 and 9.

The tool 30 is arranged in a known manner to be manually actuated via a trigger 50, which is mounted operatively to the primary handle 34, so as to ignite an explosive charge in a cartridge (not shown) loaded into the tool 30. As disclosed in Bosch U.S. Pat. No. 4,375,269, the tool 30 is arranged to be manually loaded with a magazine holding ten cartridges. Ignition of the explosive charge causes a driving ram 52 (see FIGS. 11 and 13 through 18) to be axially driven with an explosive force, which can drive a fastener, such as one of the fasteners 20, from the nosepiece assembly 36, through a metal workpiece, such as the metal decking member 12, into a concrete substrate, such as the concrete substrate 14.

Figure 5:
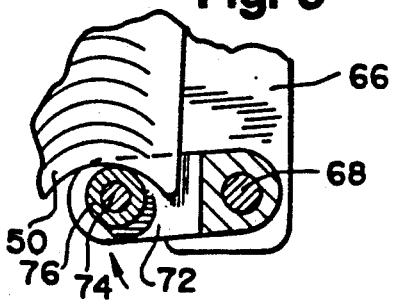
FIG. 5 is a fragmentary, sectional detail taken along line 5—5 of FIG. 3, in a direction indicated by arrows.

The trigger 50 is arranged in a known manner so as to be normally deactuated and to be manually actuated when pulled in an inward direction relative to the primary handle 34, i.e., in an upward direction in FIGS. 1, 3, and 5. It is convenient to refer to the trigger 50 as a primary trigger. The tool 30 has internal mechanisms (not shown) known heretofore for preventing the tool 30 from being actuated via the primary trigger 50 unless the nosepiece assembly 36 is pressed against an unyielding object, such as the metal decking member 12 overlying the concrete substrate 14, with sufficient force to compress the coiled spring 40 and to cause relative movement of the housing structure 32 and the nosepiece assembly 36 from the extended condition into the retracted condition.

So as to facilitate its use by a standing worker, the tool assembly 10 comprises a tubular extension 54, a lower end of which is fixed to the housing structure 32, and an upper handle 58, which is fixed to an upper end of the tubular extension 54. A secondary trigger 60 is mounted operatively to the upper handle 58 so as to be pivotally moveable between an inoperative position and an operative position. The secondary trigger 60 is arranged to actuate the primary trigger 50 remotely when the secondary trigger 60 is pivoted from its inoperative position into its operative position.

Figure 4:
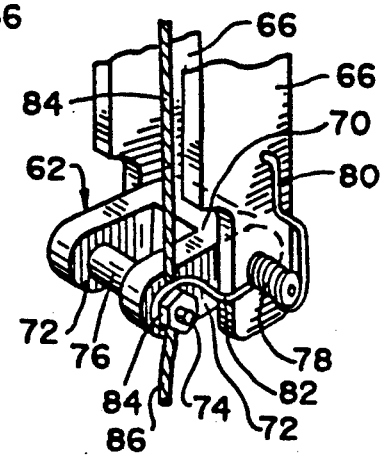
FIG. 4 is a detail taken from FIG. 3 with certain elements removed so as to reveal other elements.

As shown in FIGS. 3, 4, and 5, a remote actuator 62 is mounted operatively to the primary handle 34 via a bracket 64. The bracket 64 has two bracket arms 66, between which the remote actuator 62 is mounted pivotally via a pivot pin 68 for pivotal movement between an inoperative position and an operative position. The pivot pin 68 extends axially from one of the bracket arms 66. The remote actuator 62 is arranged to actuate the primary trigger 50, as suggested by a curved arrow in FIG. 5, when the remote actuator 62 is pivoted from its inoperative position into its operative position.

The remote actuator 62 comprises a bracket 70 having two bracket arms 72 and a cross pin 74 extending between the bracket arms 72 and from one of the bracket arms 72. The cross pin 74 is threaded where the cross pin 74 extends therefrom. A torsional spring 78 is disposed around the pivot pin 68 where the pivot pin 68 extends from one of the bracket arms 66. A bearing sleeve 76 is disposed around the cross pin 74, between the bracket arms 72, so as to permit the bearing sleeve 76 to rotate about the cross pin 74. The torsional spring 78 has a first arm 80 extending into a small hole in the same one of the bracket arms 66 and a second arm 82 bearing against the cross pin 74 where the cross pin 74 extends from one of the bracket arms 72. The second arm 82 is secured by a nut 84 threaded onto the cross pin 74 where the cross pin 74 is threaded. The torsional spring 78 biases the remote actuator 62 toward its inoperative position, in which the primary trigger 50 is not actuated.

A wire cable 86 and a flexible sleeve 88, through which the wire cable 86 is deployed so as to permit relative movement between the wire cable 86 and the flexible sleeve 88, are provided for interconnecting the primary and secondary triggers. The flexible sleeve is made from a flexible, spiral-wound, metal ribbon, which has an outer, polymeric sheath. The wire cable 86 and the flexible sleeve 88 are deployed from the upper handle 58, through an upper portion of the tubular extension 54, and through an orifice 90 in the tubular extension 54. An upper end portion of the wire cable 86 is secured to the upper handle 58. A lower end portion of the wire cable 86 is secured to the remote actuator 62. The lower end portion of the wire cable 86 is secured to the cross pin 74, by the nut 84, where the cross pin 74 extends from one of the bracket arms 72. An upper end portion of the flexible sleeve 88 is disposed so as to coact with the secondary trigger 60 in such manner that the flexible sleeve 88 is pushed along the wire cable 86, away from the upper end portion of the wire cable 86, when the secondary trigger 60 is pivoted from its inoperative position into its operative position. A lower end portion of the flexible sleeve 88 is secured to the bracket 64. The bracket 64 has a bore (not shown) through which the lower end portion of the wire cable 86 extends.

When the flexible sleeve 88 is pushed along the wire cable 86, away from the upper end portion of the wire cable 86, the wire cable 86 and the flexible sleeve 88 tend to bow outwardly, particularly but not exclusively between the orifice 90 and the bracket 64. Also, as the flexible sleeve 88 tends to be substantially incompressible, the lower end portion of the wire cable 86 is drawn upwardly into the flexible sleeve 88. Thus, when the secondary trigger 60 is actuated, i.e., pivoted from its inoperative position into its operative position, the remote actuator 62 is pivoted from its inoperative position into its operative position, whereby the primary trigger 50 is actuated.

Figure 6:
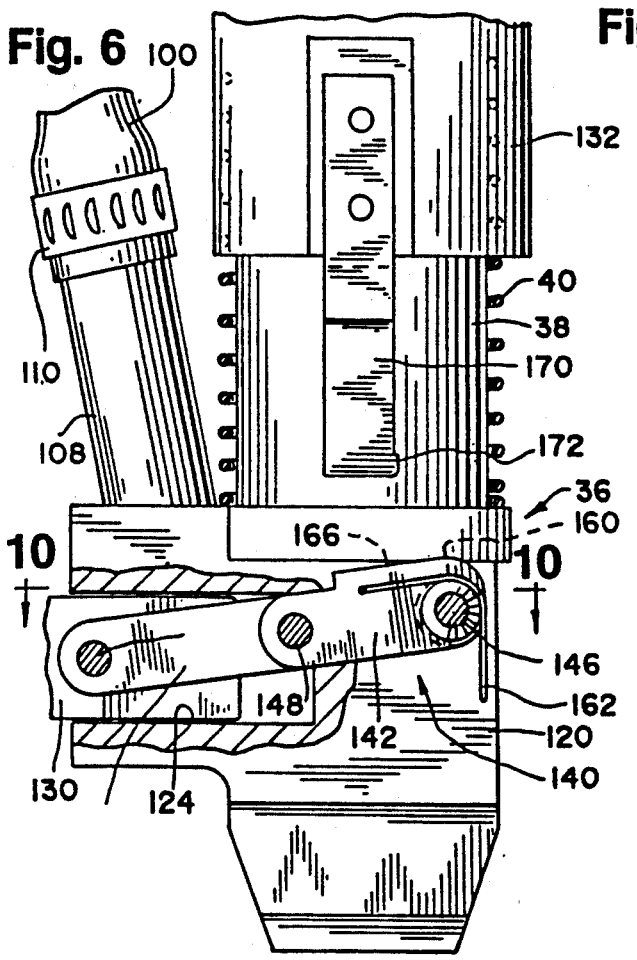
FIG. 6 is an enlarged, fragmentary, elevational detail of a nosepiece, a shuttle, and associated components of the tool, as seen from the front of the tool with the shuttle in a retracted, fastener-receiving position.
Figure 7:
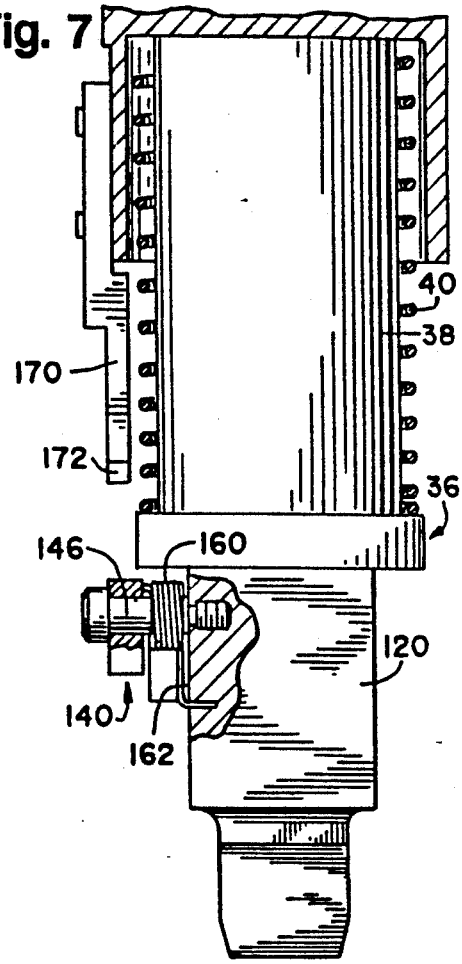
FIG. 7 is an enlarged, fragmentary, elevational detail of the same components, as seen from one side of the tool with the shuttle in the retracted position.

As shown in FIGS. 1, 2, 3, and 6, a flexible tube 100 is provided for guiding fasteners, such as the fasteners 20, successively into the nosepiece assembly 36. An upper end of the flexible tube 100 is stretched over an inlet tube 102 having a flared mouth 104, as shown in FIG. 2, and is secured by a clamping band 106. A lower end of the flexible tube 100 is stretched over an outlet tube 108, as shown in FIG. 6, and is secured by a clamping band 110. The inlet tube 102 is secured to the tubular extension 54, near the upper handle 58, by a bracket arm 112, which is clamped to the tubular extension 54. The outlet tube 108 is an element of the nosepiece assembly 36. The flexible tube 100, the inlet tube 102, and the outlet tube 108 are sized to permit fasteners, such as the fasteners 20, to be individually and successively dropped into the flared mouth 104 of the inlet tube 102, through the inlet tube 102, through the flexible tube 100, into the outlet tube 108, and through the outlet tube 108. Preferably, the flexible tube 100 is made from mesh-reinforced, polymeric tubing.

As discussed above, the tool 30 has internal mechanisms for preventing the tool 30 from being actuated unless the nosepiece assembly 36 is pressed against an unyielding object with sufficient force to compress the coiled spring 40 and to cause relative movement of the housing structure 32 and the nosepiece assembly 36 from the extended condition into the retracted condition. When the nosepiece assembly 36 is moved from its extended position into its retracted position, the flexible tube 100 can flex as necessary, even if the flexible tube 100 is filled with fasteners, such as the fasteners 20.

The nosepiece assembly 36 comprises a nosepiece 120 having an aperture 122 extending vertically through the nosepiece 120. The aperture 122 defines an axis. The aperture 122 is arranged to permit a fastener 20 to be axially driven through the aperture 122 with the washer 28 preceding the head 26. The nosepiece 120 has a slot 124 extending transversely into the nosepiece 120, having an open face, and intersecting the aperture 122.

The nosepiece assembly 36 comprises a shuttle 130, which is block-like, as shown. The shuttle 130 is disposed in the slot 124 so as to be transversely moveable along the slot 124 relative to the nosepiece 120, between a retracted, fastener-receiving position and an advanced, fastener-delivery position. The shuttle 130 is shown in its retracted position in FIGS. 6, 10, and 11, and in its advanced position in FIGS. 8, 11, 12, and 13.

A linkage 140, which comprises a first link 142 and a second link 144, interconnects the nosepiece 120 and the shuttle 130 at the open face of the slot 124 One end of the first link 142 is connected pivotally to the nosepiece 120 via a pivot pin 146. The other end of the first link 142 is connected pivotally to one end of the second link 144 via a pivot pin 148. The other end of the second link 144 is connected pivotally to the shuttle 130 via a pivot pin 150.

A torsion spring 160 is deployed around the pivot pin 146, between the first link 142 and the nosepiece 120. One arm 162 of the torsion spring 160 extends into a small hole in the nosepiece 120 so as to fix the arm 162 relative to the nosepiece 120. The other arm 166 of the torsion spring 160 extends into a small hole in the first link 142 so as to fix such arm 166 relative to the first link 142. The torsion spring 160 is wound so as to bias the first link 142 in one rotational sense (clockwise in FIGS. 6 and 8) whereby the shuttle 130 is biased toward its retracted position. The torsion spring 160 permits the shuttle 130 to move toward its advanced position.

As shown in FIGS. 6 through 9, a camming element 170 is attached to the housing structure 32 so as to extend downwardly from the housing structure 32. The camming element 170 has a camming surface 172 at the lower end. The camming element 170 is arranged so that the camming surface 172 engages a camming surface 176 of the first link 142, when the nosepiece assembly 36 is pressed against an unyielding object with sufficient force to compress the coiled spring 40, so as to pivot the first link 142 on the pivot pin 146. Upon relative movement of the housing structure and the nosepiece assembly 36 from the extended condition into the retracted condition, the camming element 170 moves the linkage 140, which overcomes the torsion spring 160 and moves the shuttle 130 from its retracted position into its advanced position.

The shuttle 130 has a passageway 180 extending vertically through the shuttle 130 and a slot 182 extending transversely from an inner end of the shuttle 130 and intersecting the passageway 180. The passageway 180 is arranged to receive a fastener 20 with the washer 28 preceding the head 26, and with the fastener 20 disposed axially in the passageway 180, and to permit the fastener 20 to be axially driven through the passageway 180. The shuttle 130 defines a cylindrical wall 184 surrounding the passageway 180 except where the slot 182 intersects the passageway 180. The width of the slot 182 is less than the diameter of the cylindrical wall 184, less than the head and washer diameters of the fastener 20, but more than the diameter of the driving ram 52, which is cylindrical except for a frusto-conical tip 186. Thus, as shown in FIG. 10, the cylindrical wall 184 is configured to surround the fastener 20 in the passageway 180 except for the slot 182.

As shown in FIGS. 10 through 18, the shuttle 130 has a wedge-shaped, Camming groove 188, which is inclined backwardly and upwardly from an upper, front edge of the shuttle 130. When a fastener 20 is received fully by the passageway 180 with the shuttle 130 in the retracted position, the tip 24 of the next fastener 20 extends slightly into the passageway 180 so as to bear on the head 26 of the underlying fastener 20. Thereupon, when the shuttle 130 is moved toward the advanced position, the tip 24 bearing thereon is cammed upwardly. by the wedge-shaped surfaces of the groove 188 so as no to interfere with the moving shuttle 130.

A permanent magnet 190 is mounted fixedly in a slot 192 in the nosepiece 120. The magnet 190 is mounted so as to extend through the slot 182 in the shuttle 130, into the inner end of the slot 124, and so as to engage the head 26 of a fastener 20 in the passageway 180, when the shuttle 130 is in the advanced position. Because the fastener 20 is made from a magnetizable metal, the magnet 190 retains- the fastener 20 in a pre-driving position in the passageway 180 when the shuttle 130 is in the advanced position so as to prevent the fastener 20 from dropping accidentally, but so as to permit the fastener 20 to be axially driven through the aperture 122 by the driving ram 52.

Because the width of the slot 182 in the shuttle 130 is less than the head and washer diameters of the fastener 20, the shuttle 130 is arranged to retract the fastener 20 at such time as the shuttle 130 is retracted, if there is a failure of ignition when the tool 30 is actuated with the shuttle 130 in the advanced position. There may be a failure of ignition simply because a worker using the tool 30 has failed to notice that all cartridges in a magazine loaded into the tool 30 have been spent.

Because the width of the slot 182 in the shuttle 130 is more than the diameter of the driving ram 52, the slot 182 provides sufficient clearance for the driving ram 52 to permit the shuttle 130 to move from the advanced position (see, e.g., FIG. 15) toward the retracted position (see, e.g., FIG. 16) even if the driving ram 52 extends into or through the passageway 180. Therefore, after the tool 30 has been used to drive a fastener 20, it is not necessary to wait for the driving ram 52 to retract before lifting the tool 10.

Figure 11:
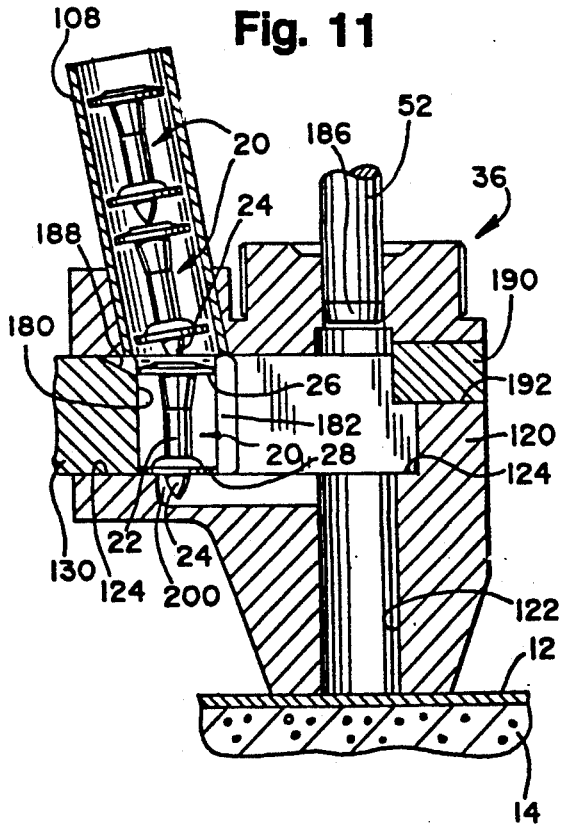
FIG. 11 is a fragmentary, sectional view taken along line 11—11 of FIG. 10, in a direction indicated by arrows.
Figure 13:
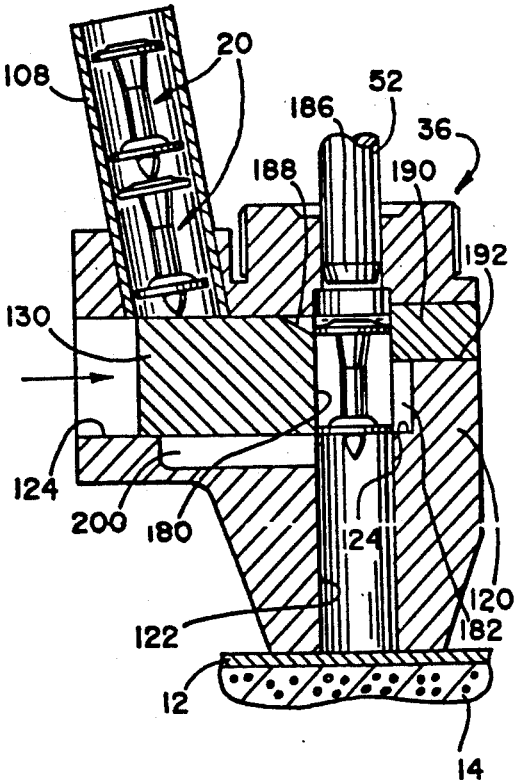
FIG. 13 is a view similar to FIG. 11 but taken with the shuttle in the advanced position.
Figure 14:
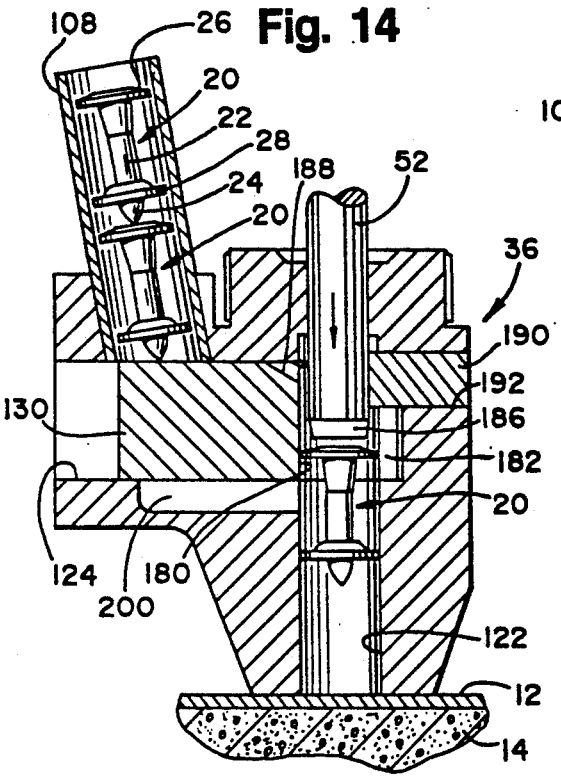
FIG. 14 is a view similar to FIGS. 11 and 13 but taken to show a driving ram having driven a fastener partly through an aperture of the nosepiece.

The nosepiece 120 has an elongate groove 200 extending along the lower wall of the slot 124 for the shuttle 130 and intersecting the aperture 122. If a fastener 20 is disposed properly when dropped through the outlet tube 108, the groove 200 receives the tip 24 and the washer 28 engages the bottom of the slot 124, as shown in FIG. 11.

Figure 17:
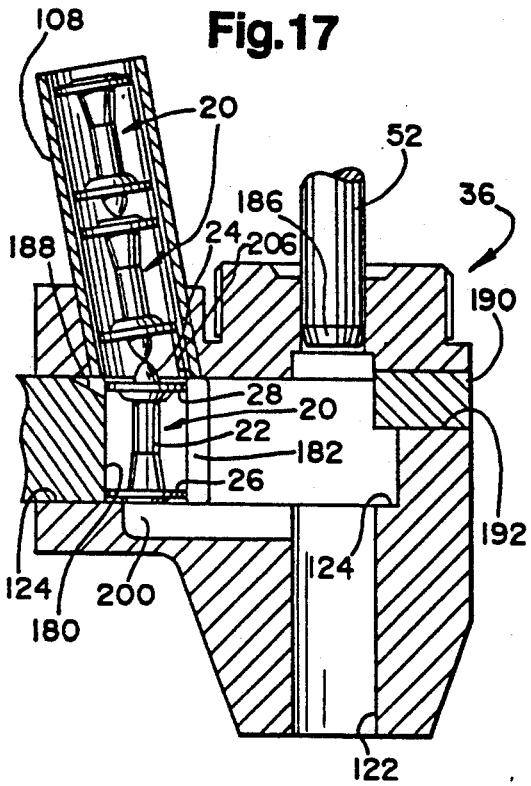
FIG. 17 is a view similar to FIG. 11 but taken to show an inverted fastener having been guided into the shuttle. The workpiece and the substrate are omitted.
Figure 18:
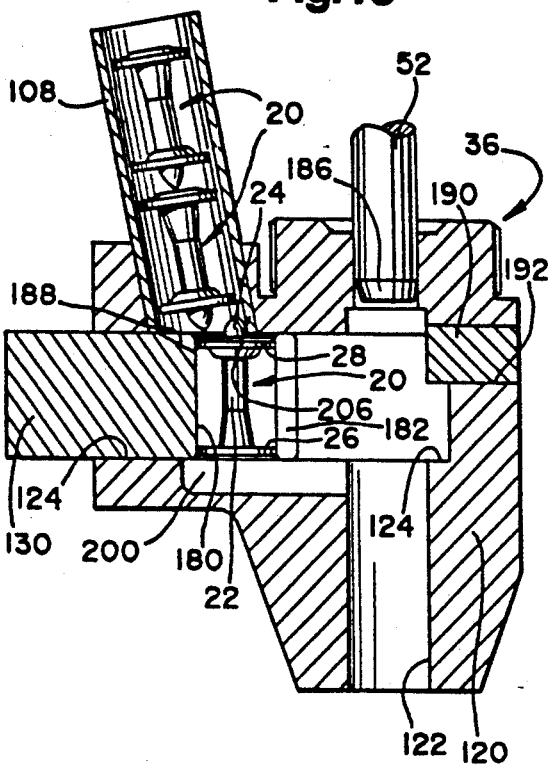
FIG. 18 is a view similar to FIG. 17 but taken to show that the shuttle cannot be fully moved into the advanced position because of interference between the inverted fastener and other structure.

Provision is made to prevent an inverted fastener 20 from being driven by the tool 10. If a fastener 20 is inverted when dropped through the outlet tube 108, the tip 24 extends upwardly and the head 26 engages the nosepiece 120 at the margins 202, 204, of the groove 200, as shown in FIG. 17. A lower portion 206 of the outlet tube 108 is disposed to engage the tip 24, as shown in FIG. 18, so as to prevent movement of the fastener 20 and the shuttle 130 into the advanced position.

Figure 19:
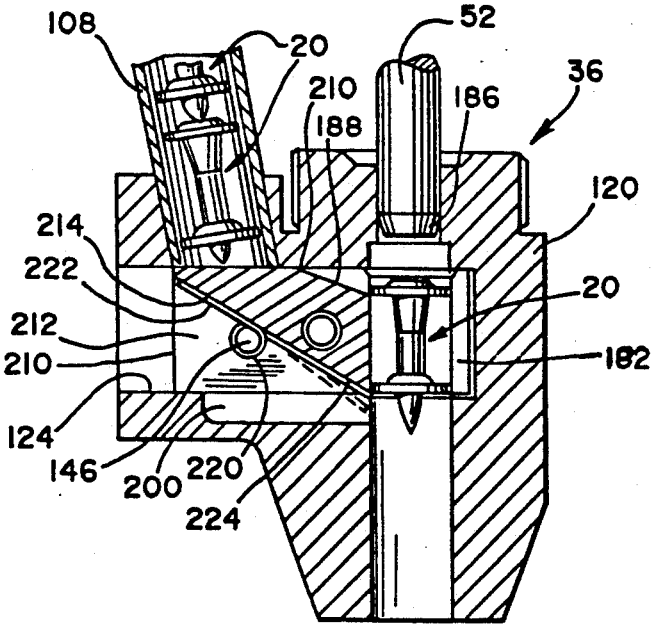
FIGS. 19 and 20 are similar views showing two alternative embodiments of this invention.

As shown in FIG. 19, in which similar elements are numbered similarly, an alternative embodiment of this invention is useful whether or not the fasteners 20 are made from a magnetizable metal. A permanent magnet is not used. A shuttle 210 is used, which is similar to the shuttle 130 except that the shuttle 210 has a hollow portion 212 with an inclined wall 214 facing downwardly and backwardly, i.e., downwardly and away from the aperture 122 of the nosepiece 120. A torsion spring 220 is mounted to the shuttle 210 in the hollow portion 212, and is deployed around the pivot pin 146 connecting the first link (not shown in FIG. 19) to the shuttle 210. One arm 222 of the torsion spring 220 extends, upwardly and backwardly and bears against the inclined wall 214. The other arm 224 of the torsion spring 220 extends oppositely and engages a fastener 20, when the fastener 20 is in the passageway 180 of the shuttle 210, so as to hold the fastener 20. Thus, as shown in FIG. 19, the spring arm 224 engages the washer 28 and extends partly beneath the washer 28. Thus, the spring arm 224 prevents the fastener 20 from dropping when the shuttle 210 is in the advanced position but permits the fastener 20 to be axially driven through the aperture 122, by the driving ram 52.

Figure 20:
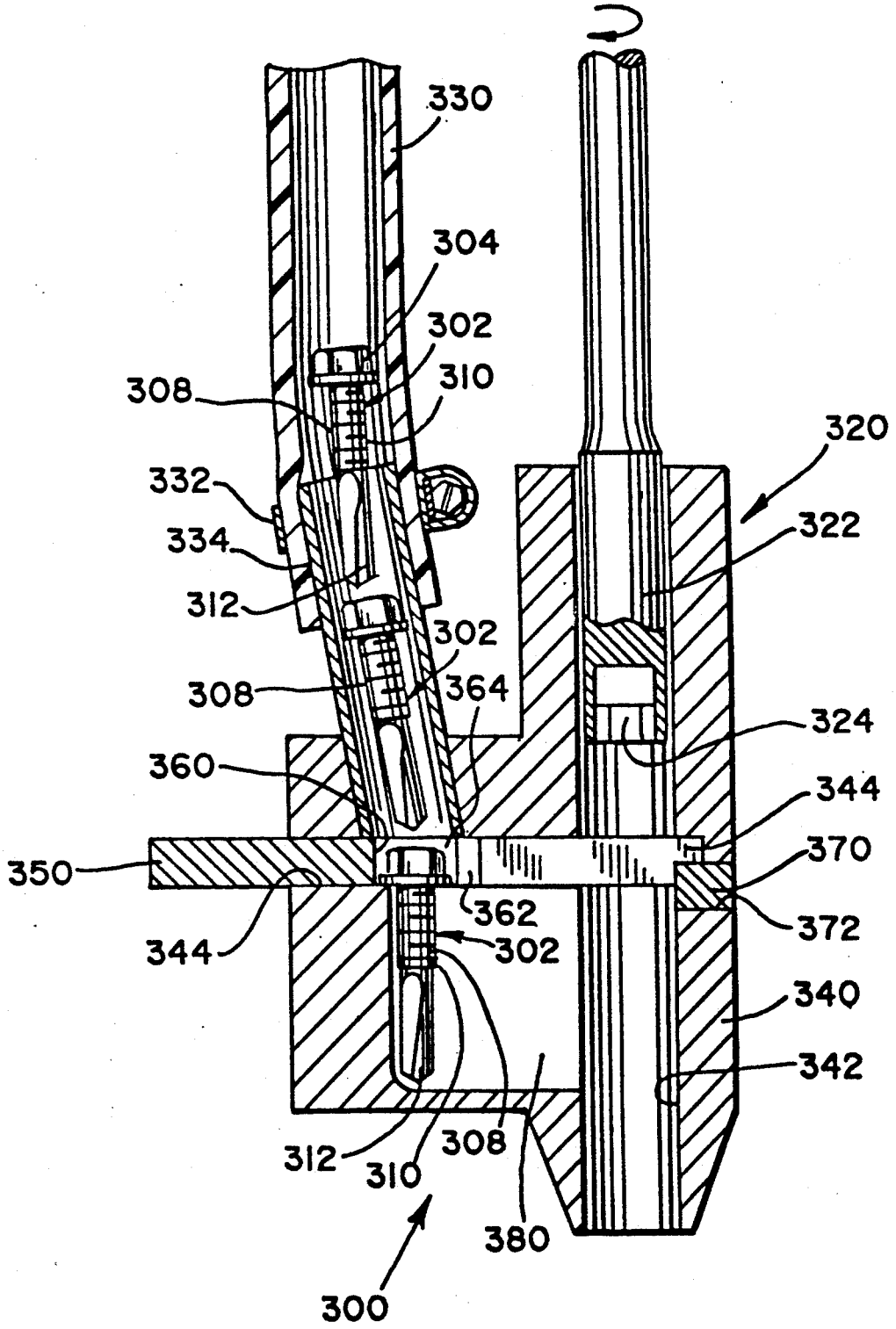

As disclosed in FIG. 20, the fastener-loading features described above can be readily adapted to a fastener-driving tool 300, which is a so-called stand-up screw gun adapted to drive screws 302 similar to the screws disclosed in Sygnator U.S. Pat. No. 4,583,898. The respective screws 302 have hexagonal heads 304, washer-like portions 306 adjacent to the heads 304, and elongate shanks 308 with threaded portions 310 adjacent to the washer-like portions 306 and with drilling tips 312 adjacent to the threaded portions 310.

Except as illustrated and described herein, the fastener-driving tool 300 may be substantially similar to prior fastener-driving tools exemplified in Murray U.S. Pat. No. 3,960,191, Dewey U.S. Pat. No. 4,236,555, and Dewey U.S. Pat. No. 4,397,412 and available commercially from ITW-Buildex (a unit of Illinois Tool Works Inc.) of Itasca, Ill., under its AUTOTRAXX trademark. Furthermore, the fastener-driving tool 300 and the screws 302 driven thereby may incorporate improvements disclosed in Janucz et al. U.S. patent application Ser. No. 07/592,129 filed Oct. 3, 1990, and assigned commonly herewith, for FASTENER HAVING RECESSED, NON-CIRCULAR HEAD, AND FASTENER-DRIVING TOOL.

The tool 300 comprises a nosepiece assembly 320, which is similar to the nosepiece assembly 36 of the tool 30, except as illustrated and described herein. Moreover, the tool 300 comprises a driving blade 322, which may be substantially similar to the driving blades of stand-up screw guns known heretofore. Thus, the driving blade 322 is provided at its lower end with a downwardly opening socket 324, which conforms to the hexagonal heads 304 of the screws 302. The driving blade 300 is arranged to be rotatably driven by an electric motor (not shown) when the tool 300 is actuated in a known manner and to be axially pushed with the socket 324 receiving the hexagonal head 304 of a screw 302, so as to rotate a screw 302, and so as to drive the screw 302 from the nosepiece assembly 320.

A flexible tube 330, which is similar to the flexible tube 100 of the tool 30, is provided for guiding the screws 302 successively into the nosepiece assembly 320 with the tips 312 preceding the heads 304. A lower end of the flexible tube 330 is secured, by a clamping band 332, over an outlet tube 334. The outlet tube 334 is similar to the outlet tube 108 of the tool 30 and is an element of the nosepiece assembly 320.

The nosepiece assembly 320 comprises a nosepiece 340 having an aperture 342 extending vertically through the nosepiece 340. The aperture 342 defines an axis. The aperture 342 is arranged to permit a screw 302 to be rotatably and axially driven through the aperture 342 with the tip 312 preceding the head 304. The nosepiece 340 has a slot 344 extending transversely into the nosepiece 340, having an open face, and intersecting the aperture 342.

The nosepiece assembly comprises a shuttle 350, which is block-like, as shown. The shuttle 350 is disposed in the slot 344 so as to be transversely moveable along the slot 344 between a retracted, fastener-receiving position and an advanced, fastener-delivery position. A linkage (not shown) similar to the linkage 140 of the tool 30 is used to move the shuttle between those positions.

The shuttle 350 has a passageway 360 extending vertically through the shuttle 350 and a slot 362 extending transversely from an inner end of the shuttle 350 and intersecting the passageway 360. The passageway 360 is arranged to receive a screw 302 with the tip 312 preceding the head 304, and with the screw 302 disposed axially in the passageway 360, and to permit the screw 302 to be rotatably and axially driven through the passageway 360. The shuttle 350 defines a cylindrical wall 364 surrounding the passageway 360 except where the slot 362 intersects the passageway 360. The width of the slot 362 is less than the diameter of the cylindrical wall 364, less than the diameter of the washer-like portion 306 of the screw 306, but more than the diameter of the driving blade 322, which is cylindrical where it is provided with the socket 324.

A permanent magnet 370, which is similar to the permanent magnet 190 of the tool 30, is mounted fixedly in a slot 372 in the nosepiece 340. The magnet 370 is mounted so as to extend through the slot 362 in the shuttle 350, into the inner end of the slot 344, and so as to engage the washer-like portion 306 of a screw 302 in the passageway 360, when the shuttle 350 is in the advanced position. If the screw 302 in the passageway 360 is made from a magnetizible metal, the magnet 370 retains the screw 302 in a pre-driving position in the passageway 360 when the shuttle 350 is in the advanced position so as to prevent the screw 302 from dropping accidentally, but so as to permit the screw 302 to be rotatably and axially driven through the aperture 342 by the driving blade 322.

The nosepiece 340 has a deep, elongate groove 380, which is analogous to the elongate groove 200 of the tool 30. The groove 380 extends along the lower wall of the slot 344 for the shuttle 350 and intersects the aperture 342. The groove 380 receives and accommodates the elongate shank 308 of a screw 302 with the washer-like portion 306 engaging the bottom of the slot 344.

Structurally and functionally, therefore, the fastener-driving tool 300 is similar in many respects to the fastener-driving tool 30.

Various other modifications may be made in the preferred embodiment described above without departing from the scope and spirit of this invention as defined by means of the appended claims. It is therefore to be understood that within the scope of the appended claims, the present invention may be practiced otherwise than as specifically described herein.

We claim:

1. A tool assembly for driving a fastener toward and into a workpiece, comprising:

a housing;

a nosepiece having an aperture defined therein for permitting a fastener to be axially driven through said nosepiece toward said workpiece;

means mounting said nosepiece for relative movement with respect to said housing;

a shuttle movable with respect to said nosepiece between a fastener-receiving position and a fastener-delivery position, and having a passageway defined therein for receiving said fastener with said fastener disposed axially within said passageway and for permitting said fastener to be axially driven through said shuttle and toward said workpiece;

means for guiding said fastener axially into said passageway of said shuttle when said shuttle is disposed at said fastener-receiving position;

means for causing resultant movement of said shuttle from said fastener-receiving position to said fastener-delivery position in response to said movement of said nosepiece with respect to said housing so as to transfer said fastener, disposed axially within said passageway of said shuttle, from said fastener-receiving position to said fastener-delivery position when said fastener is to be axially driven through said passageway of said shuttle and said aperture of said nosepiece toward said workpiece; and driving element means, comprising an axially and rotatably driven fastener driver and which si disposed so as to be axially driven through said passageway of said shuttle and into said aperture of said nose piece when said shuttle is disposed at said fastener-delivery position, for engaging said fastener disposed within said passageway of said shuttle so as to drive said fastener axially from said passageway of said shuttle and through said aperture of said nose piece into said workpiece.

2. A tool assembly as set forth in claim 1, further comprising:

means for retaining said fastener within said passageway of said shuttle when said shuttle is disposed at said delivery position so as to prevent said fastener from accidentally dropping out of said passageway of said shuttle but permitting said fastener to be axially driven from said passageway of said shuttle by said driving element means.

3. A tool assembly as set forth in claim 2, wherein:

said fastener is fabricated from a magnetizable material; and said retaining means comprises a magnet which is mounted within said nosepiece so as to engage said fastener disposed within said passageway of said shuttle when said shuttle is disposed at said delivery position whereby said fastener is releasably retained by said magnet.

4. A tool assembly as set forth in claim 3, wherein:

said magnet is fixedly mounted within said nosepiece.

5. A tool assembly as set forth in claim 4, wherein:

said fastener comprises a head portion; and said magnet is mounted within said nosepiece so as to engage said head portion of said fastener when said fastener is disposed within said passageway of said shuttle.

6. A tool assembly as set forth in claim 3, wherein:

said passageway is defined by means of a substantially annular sidewall of said shuttle which surrounds said fastener when said fastener is disposed within said passageway except at a predetermined circumferential portion thereof; and said shuttle further comprises a slot which is connected to said passageway of said shuttle at said predetermined circumferential portion thereof so as to permit said magnet of said nosepiece to extend through said slot and thereby engage said fastener disposed within said passageway of said shuttle when said shuttle is disposed at said delivery position.

7. A tool assembly as set forth in claim 6, wherein:

said fastener comprises a head portion; and said magnet is mounted within said nosepiece so as to engage said head portion of said fastener when said fastener is disposed within said passageway of said shuttle.

8. A tool assembly as set forth in claim 1, wherein:

an elongate groove is defined within said nosepiece so as to receive a tip portion of said fastener so as to accommodate said tip portion of said fastener as said shuttle moves from said receiving position to said delivery position.

9. A tool assembly as set forth in claim 1, wherein:

said means for guiding said fastener comprises a supply tube having an outlet end thereof fixedly disposed upon said nosepiece at a position which is directly above and immediately adjacent to said receiving position of said shuttle such that if said fastener is improperly oriented within said passageway of said shuttle, said outlet end of said supply tube will engage a tip portion of said fastener so as to prevent the movement of said fastener and said shuttle from said receiving position to said delivery position.

10. A tool assembly as set forth in claim 1, wherein:

said fastener comprises a head portion; and said fastener driver of said driving element means comprises a socket member for housing said head portion of said fastener so as to rotatably and axially drive said fastener into said workpiece.

11. A tool assembly as set forth in claim 10, wherein:

said head portion has a substantially hexagonal configuration; and said socket member of said fastener driver has a substantially hexagonal configuration for accommodating said hexagonal head portion of said fastener.

12. A tool assembly as set forth in claim 1, wherein:

said nosepiece is movable with respect to said housing between an extended position and a retracted position; and spring means are interposed between said housing and said nosepiece for biasing said nosepiece toward said extended position with respect to said housing.

13. A tool assembly as set forth in claim 1, wherein said means for causing resultant movement of said shuttle comprises:

linkage means interconnecting said shuttle and said nosepiece;

spring biasing means interposed between said nosepiece and said linkage means for biasing said linkage means, and said shuttle, toward said receiving position; and cam means mounted upon said housing for engaging said linkage means so as to move said linkage means, and said shuttle, against said spring biasing means, from said receiving position to said delivery position when said nosepiece is moved from said extended position to said retracted position.

14. A tool assembly as set forth in claim 1, wherein:

said nosepiece comprises a slot disposed transversely with respect to said aperture of said nosepiece for accommodating said movement of said shuttle between said receiving position and said delivery position.

* * * * *